US005353574A

United States Patent [19]

Copham et al.

[11] Patent Number: 5,353,574

[45] Date of Patent: Oct. 11, 1994

[54] SYSTEM AND DEVICE FOR PREPARING CHECKS FOR DELIVERY

[75] Inventors: David L. Copham, Forest Lake, Minn.; Shawn M. Dolan, Simi Valley, Calif.; Christopher D. Edmonson, Andover, Minn.

[73] Assignee: Liberty Share Draft & Check Printers, Inc., Arden Hills, Minn.

[21] Appl. No.: 40,554

[22] Filed: Mar. 31, 1993

[51] Int. Cl.[5] ..... B65B 11/58; B65B 3/04; B65D 5/52

[52] U.S. Cl. ..... 53/428; 53/449; 53/474; 206/45.31; 206/459.5; 206/215; 229/162

[58] Field of Search ..... 206/45.31, 45.34, 459.5, 206/215; 283/57, 58, 59; 53/449, 475, 170, 171, 173, 428, 474; 229/120.01, 162; 220/410

[56] References Cited

U.S. PATENT DOCUMENTS

| | | | |
|---|---|---|---|
| 1,682,449 | 8/1928 | Vest | 206/45.31 |
| 1,945,792 | 2/1934 | Stephens | 206/45.31 |
| 1,946,751 | 2/1934 | McCarthy | 283/58 |
| 2,022,906 | 12/1935 | Weeks | 229/162 |
| 2,296,556 | 9/1942 | Junkin | 206/45.31 |
| 2,621,785 | 12/1952 | De Pace | 206/45.31 |
| 2,887,326 | 5/1959 | Kramer | 283/58 |
| 4,441,614 | 4/1984 | Gulliver | 206/45.31 |
| 4,915,287 | 4/1990 | Volk et al. | 229/162 |

*Primary Examiner*—Paul T. Sewell
*Assistant Examiner*—Marie Denise Patterson
*Attorney, Agent, or Firm*—Kinney & Lange

[57] ABSTRACT

A method and device for preparing one or more pads of checks to be delivered to an individual is disclosed. The method includes stitching a mailing label on top of an uppermost pad of one or more pads of checks. The one or more pads of checks are placed into a check container, wherein the check container includes a box bottom, a box top having a first aperture, and a transparent material immediately surrounding the first aperture. The check container is placed into a shipping carton, wherein the shipping carton has a second aperture. The mailing label is visible through the first aperture of the box top and through the second aperture of the shipping carton.

14 Claims, 4 Drawing Sheets

SYSTEM AND DEVICE FOR PREPARING CHECKS FOR DELIVERY

BACKGROUND OF THE INVENTION

The present invention relates to a blank check processing system, and more particularly to a method of preparing a set of checks to be delivered to an individual.

In today's modern society, almost any consumer good can be purchased through use of a check. Businesses ranging from car dealerships to fast food restaurants accept checks for their goods and/or services. A great majority of adults have some form of a checking account at either a bank, a credit union, or other financial institution.

Regardless of the type of institution at which an individual has a checking account, there are a variety of account choices he may make in setting up his checking account: some checking accounts offer interest for money within the account while other accounts offer no interest; some checking accounts charge a check fee for each check written on the account while other accounts offer unlimited checking. In addition, an individual must choose a particular style of checks, whether he wants single or duplicate checks, the particular style and color of the check cover, and whether he wants overdraft protection on the checking account.

Regardless of all of the above-mentioned decisions which must be made by an individual, it is inevitable that all individuals having a checking account will eventually need to order a set of checks for their checking account. Normally, the individual fills out a check request order form and sends the form to the bank or financial institution at which the individual has the checking account. The bank or financial institution routinely forwards the check request order form to a check printing company.

The check printing company prints the set of checks, places the checks in a cardboard box, prepares a mailing label indicating the individual's name and address, packs one or more boxes of checks into a shipping carton, attaches the mailing label to the shipping carton, and delivers the carton containing boxes of checks to the individual.

Simultaneously, the check printing company proceeds with billing for the checks in one of two ways. First, the check printing company can issue an invoice to the bank or financial institution summarizing the orders which were completed for that particular bank or financial institution over a given period of time. The bank or financial institution is then responsible for notifying the individual of the amount owed for the checks, collecting the proper payment from the individual, and paying the check printing company for its services.

Second, the check printing company can manually calculate the entire customer price, including the bank or financial upcharge, postage, and delivery costs. The check printing company can bill the individual for the entire service through use of a handwritten or computer generated invoice separately mailed to the individual, or by a direct transfer of funds from the individual's checking account. The check printing company can then pay for the delivery charge, sales tax, and institution upcharges before getting reimbursed.

While either procedure works flawlessly in many circumstances, there are instances in which two separate individuals will receive the wrong set of checks.

This happens because two mailing labels get inadvertently switched and placed on the wrong box of checks. This type of mistake often causes apprehension and stress to the individuals who have received the wrong set of checks. Often, the additional time delay in receiving the correct set of checks causes ill-will towards both the financial institution and the check printing company.

Therefore, there is a need for a system and a device for preparing and delivering checks to an individual which will prevent two individuals from receiving each other's set of checks, rather than their own set of checks.

SUMMARY OF THE INVENTION

The present invention is a method and a device for preparing one or more pads of checks to be delivered to an individual which will prevent the individual from receiving a set of checks which he has not ordered.

A mailing label, which includes a return address, a customer name, a customer address, and a customer identification number, is stitched into a top pad of checks. The checks are placed into a check container having a bottom check container member, a top check container cover having a first aperture, and a transparent material immediately surrounding the first aperture. The check container is placed into a shipping carton, wherein the shipping carton has a second aperture. The mailing label is visible through the first aperture of the top check container cover and the second aperture of the shipping carton. Therefore, the need to match a non-see through shipping carrier containing a set of checks with a separate mailing label which is to be attached to the outside of the shipping carrier is eliminated.

DETAILED DESCRIPTION OF THE PREFERRED EMBODIMENTS

Figure 1:
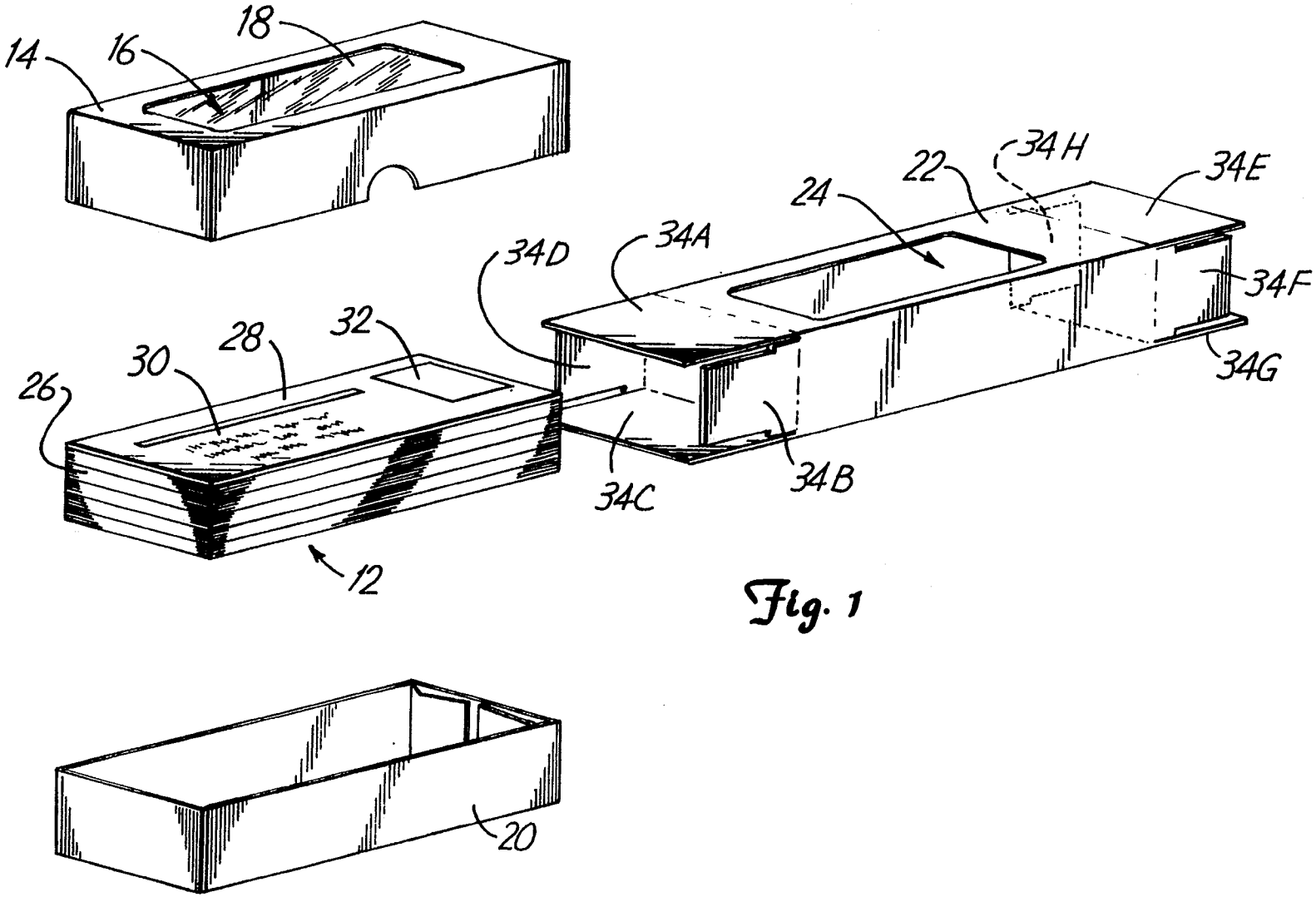
FIG. 1 is an exploded pictorial view of the present invention and includes a set of checks, a check container, and a shipping carton.

FIG. 1 is an exploded pictorial view of the present invention and includes set of checks 12, check box top 14 (which has a first aperture 16), transparent material 18, check box bottom 20, shipping carton 22 (which has a second aperture 24), top pad of checks 26, and shipping label 28 (which includes mailing label 30 and price notification label 32).

In preparing a set of checks 12 for delivery to a customer, shipping label 28 is stitched onto the top of top pad of checks 26. Shipping label 28 includes both mailing label 30 and price notification label 32. Set of checks 12 is placed into check box bottom 20 and check box top 14 is lowered onto check box bottom 20, thereby encompassing set of checks 12.

First aperture 16 has a width in the range of approximately 3.00 to 6.00 inches, and a height in the range of approximately 1.50 to 3.00 inches. In one preferred embodiment, first aperture 16 has a width of approximately 4.50 inches and a height of approximately 2.10 inches. Similarly, second aperture 24 has a width in the range of approximately 3.00 to 6.00 inches and a height in the range of approximately 1.50 to 3.00 inches. In one preferred embodiment, second aperture 24 has a width of approximately 4.50 inches and a height of approximately 2.10 inches.

Mailing label 30, which includes a return address, a customer name, a customer address, and a customer identification number, is visible through a first window formed by first aperture 16. However, price notification label 32, which includes personal information not relevant for delivery, is not visible through first aperture 16 and transparent material 18. Transparent material 18, which in one embodiment is made of a cellophane material, is fastened to an inner surface of top check container 14 immediately surrounding first aperture 16. Transparent material 18 prevents damage to set of checks 12 during delivery and allows mailing label 30 to be visible.

Check box top 14 and check box bottom 20 form a box which encompasses set of checks 12 and which can be inserted into shipping carton 22. Second aperture 24 of shipping carton 22 is substantially similar in shape to first aperture 16 of check box top 14. When the box formed by check box top 14 and check box bottom 20 is centered within shipping carton 22, first aperture 16 lines up with second aperture 24 to allow mailing label 30 to be visible. End flaps 34A, 34B, 34C, 34D, 34E, 34F, 34G, and 34H can then be folded and sealed. A separate mailing label laminated to the outside of shipping carton 22 is not necessary since mailing label 30 of shipping label 28 includes all necessary delivery information and is visible through both first aperture 16 and second aperture 24. This procedure and design, therefore, prevents a customer from receiving the wrong set of checks.

Figure 2D:
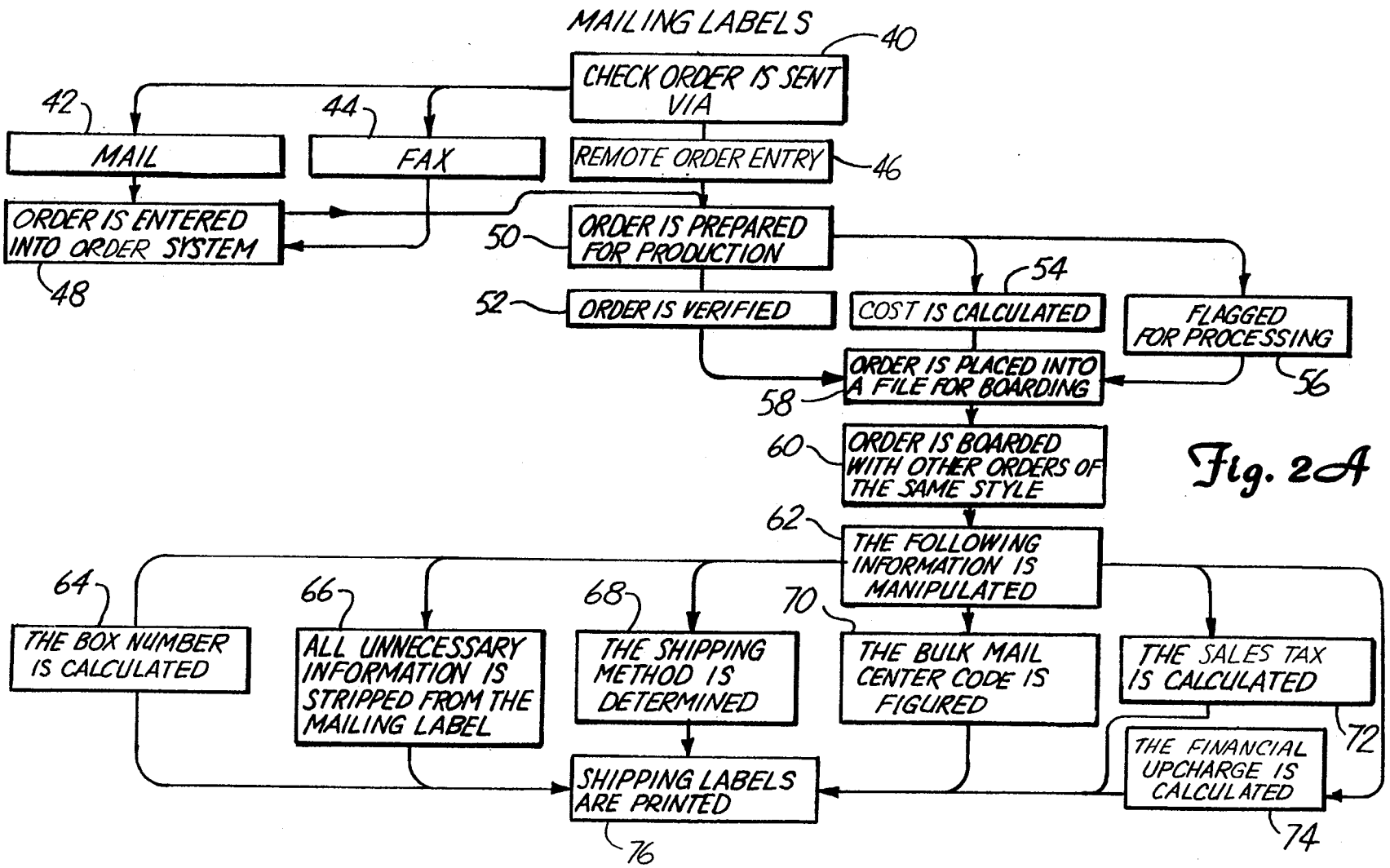
FIGS. 2A and 2B are a flow diagram summarizing the production, billing, and delivery procedures.
Figure 2B:
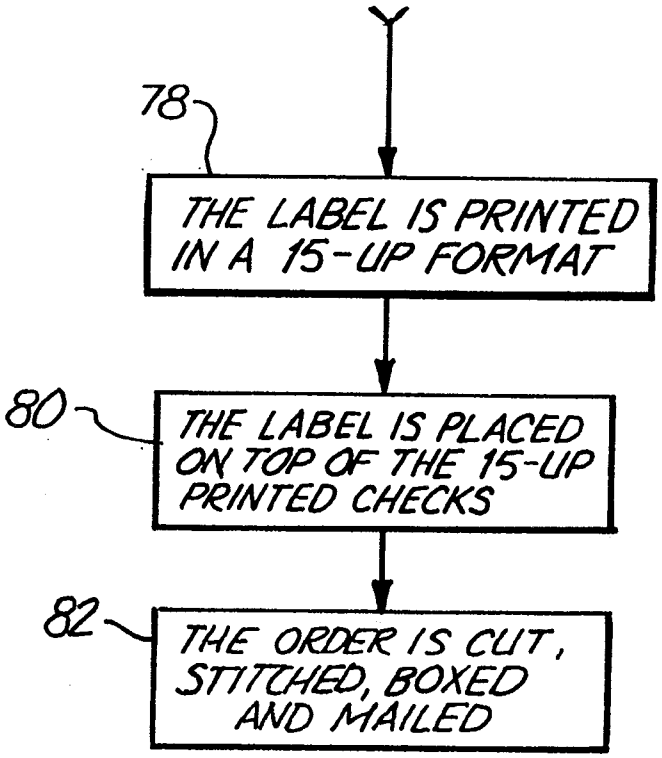

FIGS. 2A and 2B are a flow diagram summarizing the production, billing, and delivery procedures for set of checks 12 of FIG. 1.

A customer wishing to receive a set of checks sends a check order to either a check printing company or to the bank or financial institution at which the customer has a checking account. The bank or financial institution then forwards the check request to a check printing company (as indicated by box 40). The check order can be sent to the check printing company via mail (as indicated by box 42), by fax (as indicated by box 44), or by remote order entry (as indicated by box 46). If the check order is sent via mail or fax, the order is manually entered into an order system (as indicated by box 48).

Once the check order is entered into the order system, the entire order is prepared for production through a series of several automated steps (as indicated by box 50). The check order is automatically verified for accuracy and completeness (as indicated by box 52), the printer's cost is automatically calculated by accessing a database containing information relating to costs for various check styles in various quantities (as indicated by box 54), and the check order is automatically flagged for processing (as indicated by box 56).

Once the check order is prepared for production, it is placed into a file for boarding (as indicated by box 58). The order is then boarded with orders from other customers requesting the same particular check style (as indicated by box 60). The check orders are printed in either a fifteen-up format, a twelve-up format, or a nine-up format. In one preferred embodiment, a fifteen-up format is used which allows up to fifteen check orders requesting the same style of checks to be filled at one time in a M by N matrix format, wherein M and N are integers representing the number of rows and columns, respectively. In the preferred embodiment, the matrix format has five rows and three columns. The fifteen orders will therefore be filled simultaneously.

Once the order is boarded and printed, information from the check order can be manipulated (as indicated by box 62). Depending on the amount of checks ordered by an individual, it is common to deliver set of checks 12 to the customer in more than one check container. Therefore, the box number for each check container is calculated (as indicated by box 64).

All unnecessary information relating to the customer is removed from the mailing label in order to maintain the customer's privacy (as indicated by box 66). This stripped information includes a customer's telephone number, a customer's driver's license number, and a customer's social security number. Also, the shipping method desired to deliver set of checks 12 to the customer is determined (as indicated by box 68). Depending on the customer, the checks may be delivered via regular U.S. Mail, United Parcel Service, or Express Mail. In addition, the bulk mail center code, the sales tax, and the financial upcharge are all automatically calculated by accessing several databases containing standardized information relating to postage charges, sales taxes for various states and countries, and financial upcharges charged by various financial institutions (as indicated by boxes 70, 72, and 74, respectively).

Once the above-mentioned information has been manipulated, shipping labels are automatically printed (as indicated by box 76). These labels are printed in either a fifteen-up format (as indicated by box 78), a twelve-up format, or a nine-up format. The fifteen-up format allows fifteen labels to be printed at one time in a matrix format having five rows and three columns. The labels are then placed on top of the fifteen-up printed checks (as indicated by box 80). Each check order is cut, the shipping label is stitched on top of the uppermost check pad, the pads of checks are boxed, and the boxes are mailed to the customer (as indicated by box 82).

Figure 3:
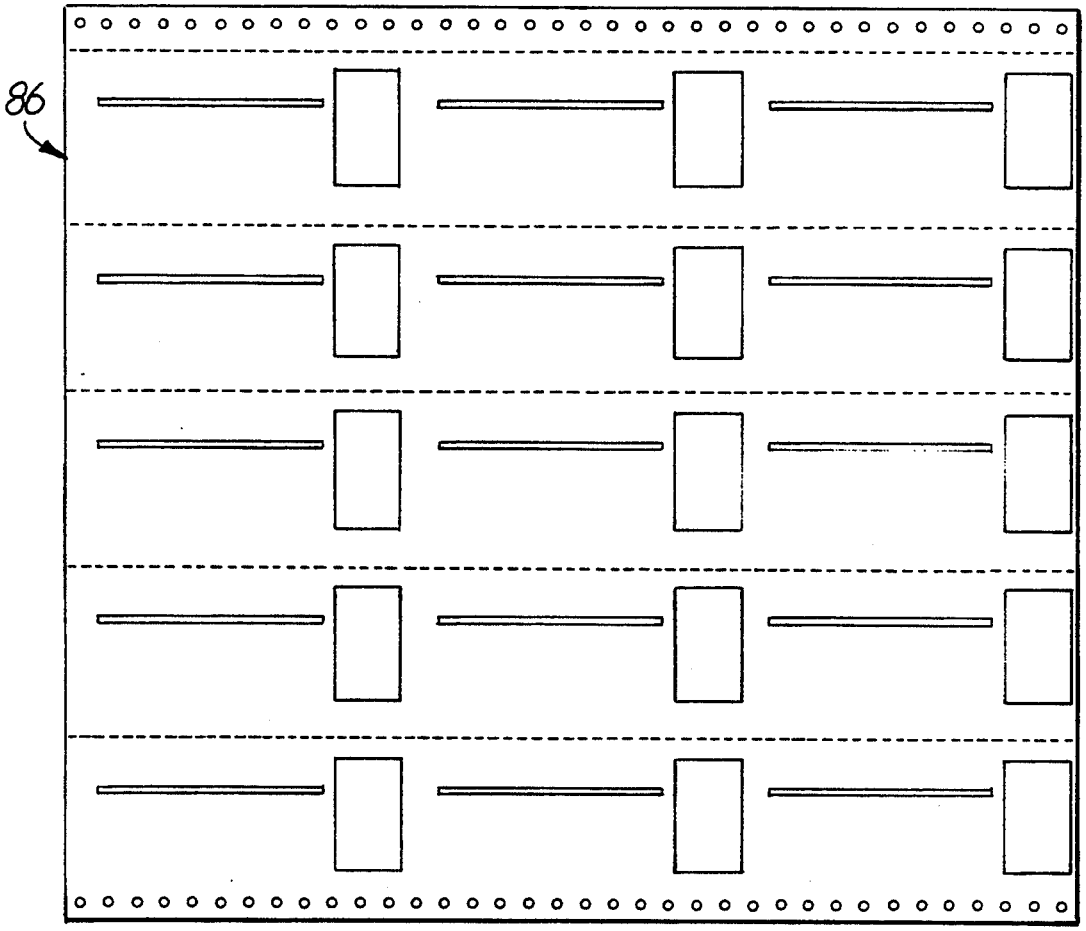
FIG. 3 is a top view of a printed sheet of shipping labels.

FIG. 3 is a matrix of several shipping labels shown in block diagram form. Matrix 86 is a M by N matrix, wherein M and N are integers. In one preferred embodiment, matrix 86 comprises five rows and three columns of shipping labels and illustrates the fifteen-up format in which the shipping labels are printed as indicated by box 78 of FIG. 2B. Once fifteen check orders are bordered with other orders of the same check style and printed in a fifteen-up format, matrix 86 is placed on top of the fifteen check orders, as indicated by box 80 of FIG. 2B. The order is then cut, stitched into check pads, boxed, and mailed to the individual customers.

Figure 4:
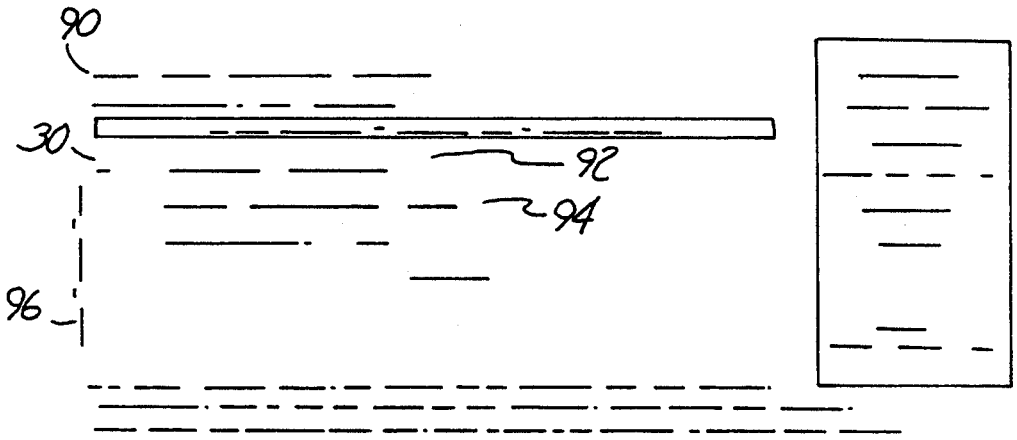
FIG. 4 shows a shipping label including both a mailing label and a price notification label.

FIG. 4 shows shipping label 28 including both mailing label 30 and price notification label 32. As can be seen in FIG. 4, mailing label 30 includes return address 90, customer name 92, customer address 94, and customer identification number 96.

Price notification label 32 includes a price which will be deducted from the checking account of the customer, an indication of the box number, the type of check cover ordered, and the method of mailing the customer his check blanks.

As discussed earlier, shipping label 28 would be stitched onto the top of set of checks 12 and enclosed by check box top 14 and check box bottom 20. The check box formed by check box top 14 and check box bottom 20 is then inserted into shipping carton 22. Mailing label 30 can be viewed through first aperture 16 and second aperture 24 while price notification label 32 may not be viewed through either first aperture 16 or second aperture 24.

Therefore, the possibility of placing an incorrect mailing label onto a box of checks is eliminated. Likewise, upon receiving the correct set of checks, the customer is automatically notified of the amount of money which will be deducted from his account for the set of checks.

Although the present invention has been described with reference to preferred embodiments, workers skilled in the art will recognize that changes may be made in form and detail without departing from the spirit and scope of the invention.

What is claimed is:

1. A method of preparing a pad of checks for delivery to a customer, the method comprising:

receiving a check request order requesting the pad of checks having a particular check style;

grouping the check request order with a plurality of check request orders requesting the particular check style into a matrix having M rows and N columns, wherein M and N are integers;

printing a plurality of sheets of checks, wherein each sheet of the plurality of sheets includes a plurality of checks corresponding to the plurality of check request orders requesting the particular check style thereby creating a plurality of stacks of checks wherein each stack of the plurality of stacks of checks corresponds to a corresponding check request order;

printing a sheet of shipping labels, wherein the sheet of shipping labels includes a plurality of shipping labels corresponding to the plurality of check request order;

placing the sheet of shipping labels on top of the plurality of sheets of checks, wherein each shipping label of the sheet of shipping labels is placed on top of a corresponding stack of checks;

separating the stack of checks having a corresponding shipping label attached thereto;

stitching the stack of checks having a shipping label attached thereto into a check pad;

placing the check pad into a check container, the check container comprising: a box bottom; a box top having a first aperture; and a transparent material fastened to an inside surface of the box top immediately surrounding the first aperture;

placing the check container into a shipping carton, the shipping carton having a second aperture; and wherein the shipping label is visible through the first aperture of the top check container cover and the second aperture of the shipping carton.

2. The method of claim 1 wherein shipping label includes:

a return address;

a name of the customer;

an address of the customer; and a customer identification number.

3. The method of claim 2 wherein the return address is an address of a financial institution.

4. The method of claim 1 wherein the first aperture of the box top has a width in the range of approximately 3.00 to 6.00 inches.

5. The method of claim 4 wherein the width of the first aperture is approximately 4.50 inches.

6. The method of claim 1 wherein the first aperture of the box top has a height in the range of approximately 1.50 to 3.00 inches.

7. The method of claim 6 wherein the height of the first aperture is approximately 2.10 inches.

8. The method of claim 1 wherein the second aperture of the shipping carton has a width in the range of approximately 3.00 to 6.00 inches.

9. The method of claim 8 wherein the width of the second aperture is approximately 4.50 inches.

10. The method of claim 1 wherein the second aperture of the shipping carton has a height in the range of approximately 1.50 to 3.00 inches.

11. The method of claim 10 wherein the height of the second aperture is approximately 2.10 inches.

12. The method of claim 1 wherein the check container is made of paperboard.

13. The method of claim 1 wherein the shipping carton is made of paperboard.

14. The method of claim 1 wherein the transparent material is cellophane.

* * * * *

UNITED STATES PATENT AND TRADEMARK OFFICE

CERTIFICATE OF CORRECTION

PATENT NO. : 5,353,574

DATED : October 11, 1994

INVENTOR(S) : DAVID L. COPHAM, SHAWN M. DOLAN, CHRISTOPHER D. EDMONSON

It is certified that error appears in the above-indentified patent and that said Letters Patent is hereby corrected as shown below:

Col. 6, delete lines 3-7, insert --placing the check pad into a check container, the check container comprising:

a box bottom;

a box top having a first aperture; and a transparent material fastened to an inside surface of the box top immediately surrounding the first aperture;--

Col. 6, line 13, after "wherein", insert --the--

Signed and Sealed this

Fourteenth Day of March, 1995

Bruce Lehman

*Attest:*

BRUCE LEHMAN

*Attesting Officer*

*Commissioner of Patents and Trademarks*